US012589936B2

(12) United States Patent
Tecchiolli et al.

(10) Patent No.: US 12,589,936 B2
(45) Date of Patent: Mar. 31, 2026

(54) SYSTEM FOR DISPENSING A FLUID SUBSTANCE

(71) Applicant: Coster Tecnologie Speciali S.p.A., Calceranica al Lago (IT)

(72) Inventors: Alfeo Tecchiolli, Meano (IT); Maurizio Motter, Pergine Valsugana (IT); Fabiano Zeni, Mezzano (IT)

(73) Assignee: Coster Tecnologie Speciali S.p.A., Calceranica al Lago (IT)

( * ) Notice: Subject to any disclaimer, the term of this patent is extended or adjusted under 35 U.S.C. 154(b) by 170 days.

(21) Appl. No.: 18/542,724

(22) Filed: Dec. 17, 2023

(65) Prior Publication Data

US 2024/0199313 A1 Jun. 20, 2024

(30) Foreign Application Priority Data

Dec. 20, 2022 (IT) ..... 102022000026094

(51) Int. Cl.
*B65D 83/48* (2006.01)
*B65D 83/20* (2006.01)

(52) U.S. Cl.
CPC ..... *B65D 83/48* (2013.01); *B65D 83/20* (2013.01)

(58) Field of Classification Search
CPC ..... B65D 83/48; B65D 83/20; B65D 83/44; B65D 83/7535; B05B 11/0067; B05B 11/007; B05B 12/088; G05D 7/0106; G05D 16/0647
See application file for complete search history.

(56) References Cited

U.S. PATENT DOCUMENTS

| | | | | |
|---|---|---|---|---|
| 4,940,170 | A | 7/1990 | Popp-Ginsbach | |
| 9,483,060 | B2 * | 11/2016 | Edwards | F16K 31/126 |
| 2008/0011365 | A1 | 1/2008 | Newton | |
| 2015/0034181 | A1 * | 2/2015 | Lindmayer | G05D 16/0647 137/505.41 |

FOREIGN PATENT DOCUMENTS

WO 2017178780 A2 10/2017

* cited by examiner

*Primary Examiner* — Vishal Pancholi
(74) *Attorney, Agent, or Firm* — Dickinson Wright PLLC; Andrew D. Dorisio

(57) ABSTRACT

A dispensing system includes a container for a fluid substance having a hollow stem and dispensing means for feeding the pressurised substance thereto. A cap includes a base body including a first seat for coupling to the stem, the base body partially defining a conduit presenting a first end in fluid communication with the seat and a second end coupled with a spray nozzle. A pressure regulator regulates passage of the substance according to the pressure in the stem to reduce passage due to an increase in pressure in the cavity and increase the passage otherwise, in order to maintain an essentially constant pressure downstream of the regulator even in the presence of variable upstream pressure. A valve element on the conduit between the regulator and the nozzle may close the conduit when the pressure present inside the latter is below a predetermined threshold and open the conduit otherwise.

9 Claims, 3 Drawing Sheets

SYSTEM FOR DISPENSING A FLUID SUBSTANCE

This application claims priority to Italian Patent Application for Invention No. 102022000026094 filed on Dec. 20, 2022, the disclosure of which is hereby incorporated by reference.

FIELD OF THE INVENTION

The present invention relates to a system for dispensing a fluid substance.

In particular it refers to a dispensing system that sprays a fluid substance housed in a container; the fluid substance can be contained in the pressurised container or can be brought under pressure by a manual pump coupled with the container.

BACKGROUND ART

U.S. Pat. No. 4,940,170 describes a spray cap that features a pressure regulator, or rather a pressure reducer, which regulates the supply pressure of a spray nozzle. Essentially, the pressure regulator reduces the pressure present in the pressurised can to a lower value, in order to optimise the pressure at the nozzle, regardless of the pressure present in the can (which is higher when there is plenty of substance to dispense, i.e. the can is full, and lower when the substance to be dispensed is almost finished).

This cap has dispensing faults, especially when the can is almost empty or has just been used for dispensing.

Indeed, it tends to drip from the nozzle (dripping) or squirts in an uncontrolled manner (drooling or jetting).

SUMMARY OF THE INVENTION

The object of the present invention is to provide a system for dispensing a fluid substance which is improved compared with the prior art.

A further object of the invention is to provide a dispensing system that minimises or eliminates dispensing faults found in the prior art.

This and other objects are achieved by means of a dispensing system according to the technical teachings of the claims annexed hereto.

BRIEF DESCRIPTION OF THE FIGURES

Further features and advantages of the innovation will become clearer in the description of a preferred but not exclusive embodiment of the device, illustrated—by way of a non-limiting example—in the drawings appended hereto, in which.

DETAILED DESCRIPTION OF THE INVENTION

With reference to the figures stated, reference number 100 is used to denote, as a whole, a system for dispensing a fluid substance.

In this text, the term 'fluid substance' S means a substance designed to be sprayed.

The said substance may be, for example, a household substance (an air freshener, a cleaning product, etc.) a substance for the body (for example a sun lotion, a perfume, a deodorant, a hairspray etc.), a medical product, or a technical product such as a paint, lubricant, etc.

The substance S is housed, directly or inside a deformable bag, in a container 5.

Figure 1:
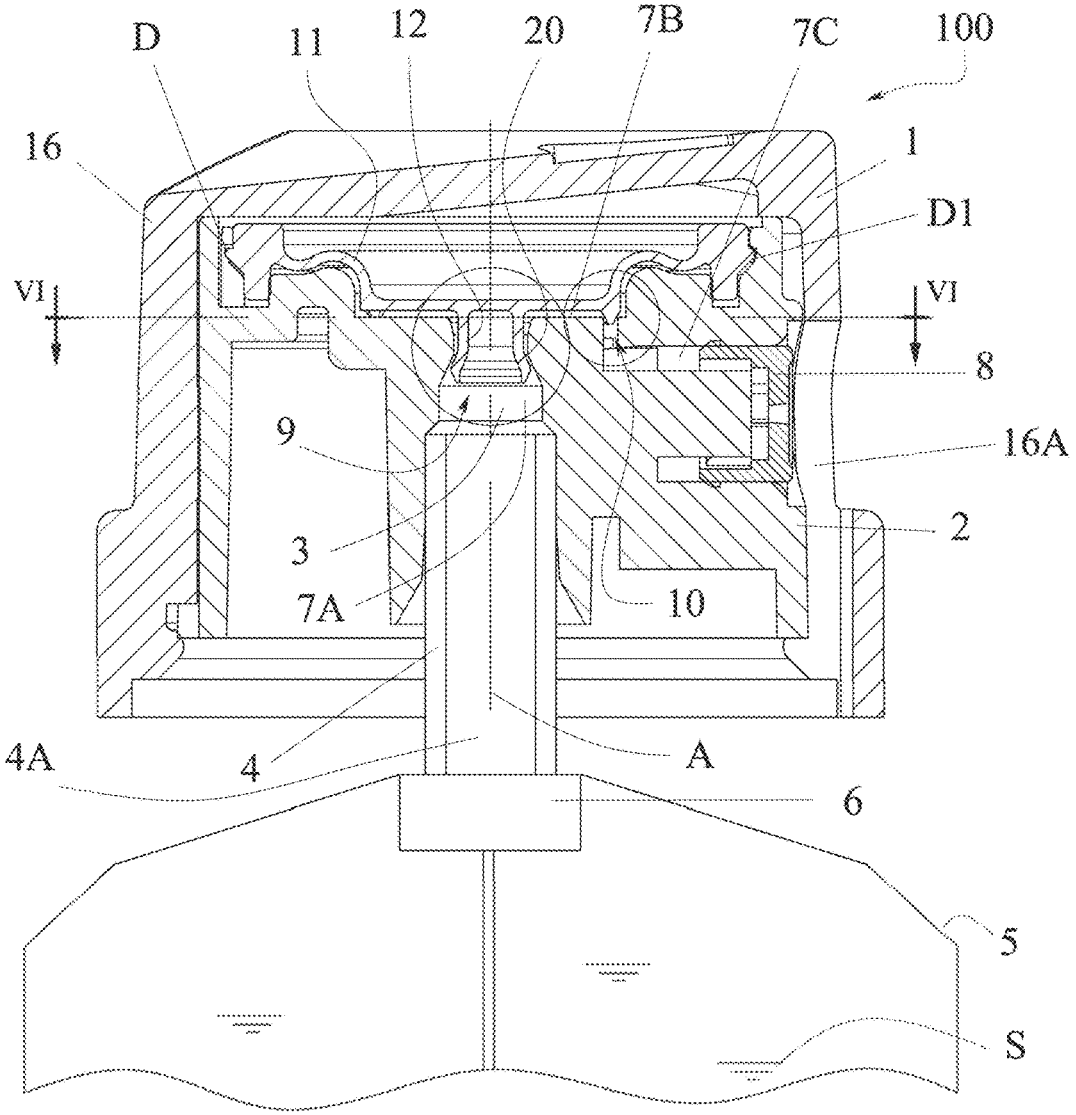
FIG. 1 is a cross-sectional view of the system according to the present invention.
Figure 2:
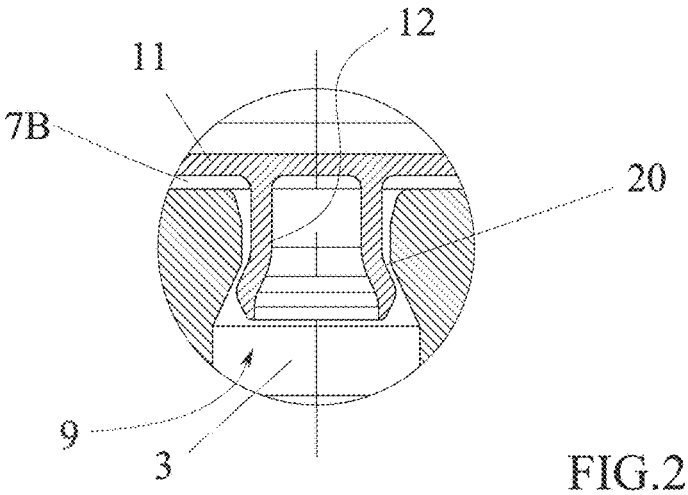
FIG. 2 is an enlargement of the part circled in the large circle in FIG. 1.
Figure 3:
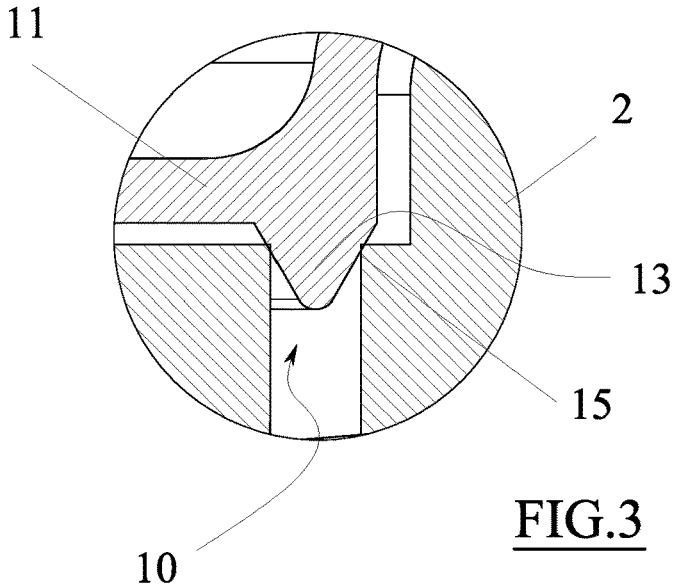
FIG. 3 is an enlargement of the part circled in the small circle in FIG. 1.

The container 5 may be a pressurised vessel (for example an aerosol can), equipped with the said dispensing means 6 which allow the substance S to be delivered, under pressure, to a cavity 4A of a stem coupled with the container, or rather to a valve 6 coupled to the container 5. The valve 6 may be conventionally configured so as to open when a displacement of the stem 4 occurs (downwards in FIG. 1) upon a cap 1 (or cover) coupled to the said stem being pressed, and to close when the pressure on the cap ceases.

Alternatively, the said dispensing means 6 comprise a pump which is likewise activated by the displacement of the said stem 4; the pump pressurises the fluid substance S taken from the container 5 and conveys the said pressurised fluid into the stem cavity 4A, also in a conventional way.

The dispensing means may be coupled to a suction tube (not shown), preferably if the substance S is housed directly in the container 5 (whether the said container is pressurised or not).

The suction tube may also not be present, even though the substance is housed directly in the container. In this case, there may be a mobile bottom (better known as a piston) which rises as a result of the dispensing of the product.

In the event that the substance S is housed indirectly in the container 5, therefore, for example in a deformable bag which is pressurised externally or coupled to an airless pump, the suction tube may be absent.

Therefore, the dispensing system 100 includes a container 5 configured to house (directly or indirectly) a fluid substance S.

The container includes a hollow stem 4 coupled with dispensing means 6 configured to deliver the said substance S, under pressure, into the cavity 4A of the hollow stem 4, following displacement of the said stem.

The system further comprises a cap 1, the cap comprising a base body 2 in which a first seat 3 is defined, configured to sealingly couple to the said hollow stem 4.

The base body delimits, at least partially, a conduit 7A, 7B, 7C, the conduit 7A, 7B, 7C featuring a first end in fluid flow communication with the said seat 3 and a second end coupled to a spray nozzle 8.

On the conduit 7A, 7B, 7C, there is a pressure regulator 9 configured to regulate a passage section 20 for the flow of the said substance S according to the pressure present in the cavity 4A of the stem 4 so as to reduce the passage section in the event of an increase in pressure in the said cavity 4A and increase the passage section 20 in the event of a reduction in the pressure present in cavity 4A, all to maintain a pressure downstream of the pressure regulator 9 which is essentially constant even in the presence of a certain pressure upstream of the pressure regulator 9, therefore in the can, or downstream of the manual pump.

This pressure, especially in an aerosol can, also varies considerably over the useful life of the system. Indeed, when the can is full, the pressure is higher, for example around 8 bar, while when the can is empty (because the substance has been dispensed) the pressure can even drop to 2 bar.

The pressure e regulator 9, in practice, reduces the pressure at the nozzle, bringing it into an optimal operating range for the said nozzle, for example around 2-3 bar, regardless of the pressure in the can (or the delivery pressure of the manual pump, which is also slightly variable during the actuation stroke, and therefore may experience peaks in pressure).

Obviously, the regulator 9 cannot raise the delivery pressure, only reduce it.

On the conduit 7A, 7B, 7C, between the pressure regulator 9 and the nozzle 8, there is a valve element 10 configured to close the conduit 7A, 7B, 7C when the pressure present inside the said conduit is below a predetermined threshold and to open the conduit, instead, when the pressure in the conduit is above the said threshold.

In practice, the valve element 10, at the end of dispensing, closes when the pressure drops below a predetermined threshold which is a fixed value of between 2.5 and 3.5 bar, preferably approximately 3 bar, or the threshold can be a pressure range of between 2.5 and 3.5 bar, preferably a pressure range in the vicinity of 3 bar. In this way, dripping or drooling phenomena that can occur in actuation transients at the end of system actuation are eliminated or minimised.

It must be said that, in aerosol cans, the phenomenon of a pressure surge which can cause dripping from the nozzle can also occur when the valve 6 is closed, far from an opening transient. This is due to the vaporisation of part of the propellant (for example nitrogen) which remains dissolved in the substance S present downstream of the valve 6. In this case, the presence of the valve element 10 prevents or minimises the expulsion of the substance from the nozzle, minimising or preventing dripping.

On the other hand, the valve element 10 opens only when the pressure upstream of the valve element exceeds the said predetermined threshold, allowing the substance S to reach the nozzle 8 with a pressure which is always sufficient to generate excellent spray (therefore preventing or minimising jetting phenomena).

A further advantage due to the presence of the valve element 10 is that of completely preventing the expulsion of the substance S through the nozzle (even with the stem in the dispensing position) if the pressure upstream of the valve element 10 is not sufficient to spray the substance S in an optimal manner through the nozzle 8 (therefore, for example, if the aerosol can is empty, or if any pump present is operated with too little force or too slowly).

According to the invention, at least part of the conduit 7A, 7B, 7C is at least partially delimited by a membrane element 11 which supports a first shutter 12 on the pressure regulator 9 and a second shutter 13 on the valve element 10.

The membrane element 11 has an essentially elastic or viscoelastic behaviour and allows an essentially axial (elastic) displacement along axis A of at least the first shutter 12 but advantageously also of the second shutter 13.

The first 12 and the second shutter 13 are made in a single piece (integrally made) with the said membrane element 11.

The membrane element 11 is configured so as to elastically preload (in an optimised manner) the second shutter 13, allowing the said shutter to operate according to the methods envisaged and described here.

In parallel, the membrane 11 also keeps the first shutter 12 suspended, allowing the latter to undergo a controlled (essentially elastic) displacement, preferably along axis A.

One or more of the following materials can be useful for the production of the membrane element 11: PE, PP, POM, PET, PA, PBT, TPE, TPO, preferably with elastic-plastic behaviour.

The membrane 11 can be fixed, preferably in an undercut (and sealed) manner, to the said base body 2.

For this purpose, the membrane 11 can feature a tooth D which engages, in an undercut manner, in a corresponding seat D1 made in the base body 2.

Figure 5:
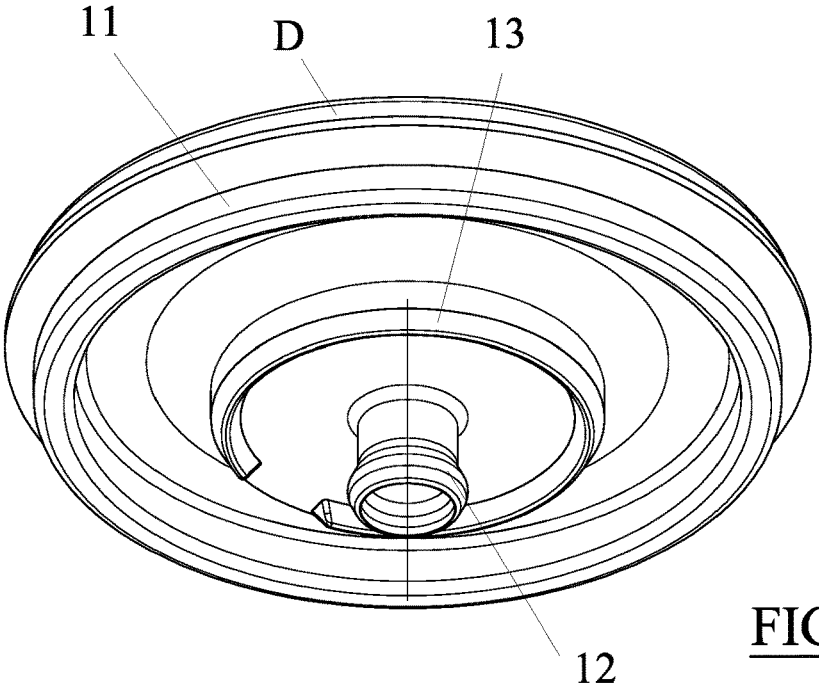
FIG. 5 is a perspective bottom-up view of part of the system in FIG. 1.
Figure 6:
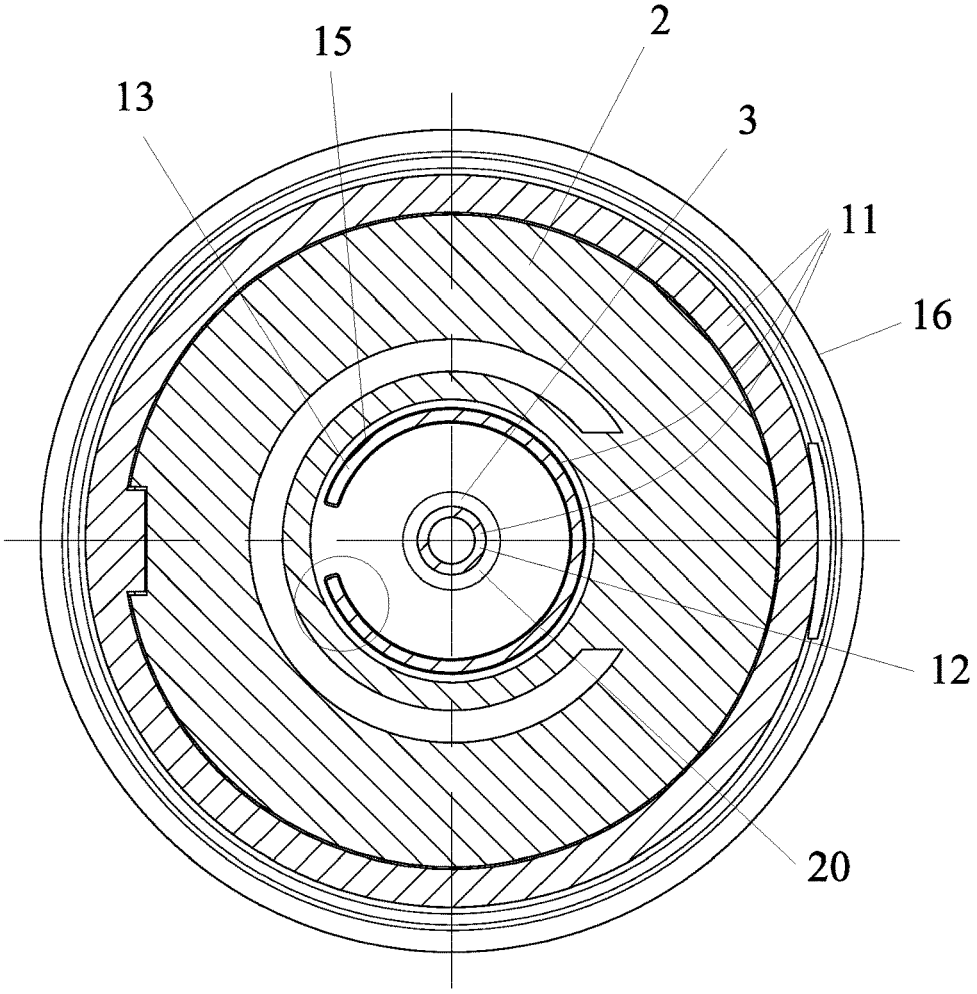
FIG. 6 is a sectional view taken along line VI-VI in FIG. 1.

As can be seen in FIG. 5, the second shutter 13 can be shaped like a lip with a curved oblong conformation, preferably in the shape of a curved arc, the valve element 10 comprising a second seat 15 with a conformation corresponding to that of the shutter 13 (FIG. 6).

Advantageously, the curve is a circumference or an ellipse.

The angular range of the second shutter 13 can be greater than 90°, preferably greater than 180°, even more preferably between 350° and 300°.

Figure 4:
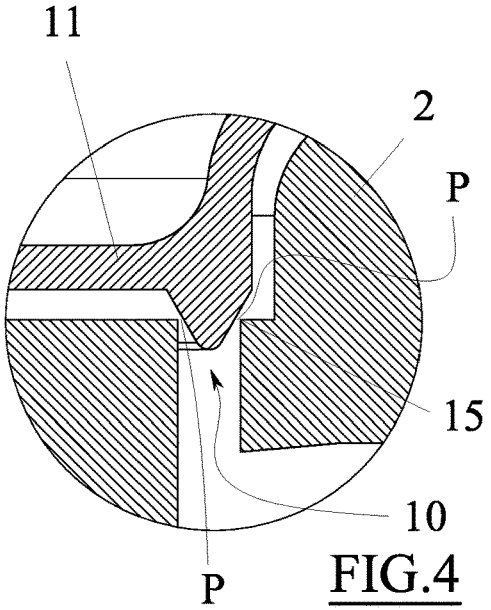
FIG. 4 shows the sectional view in FIG. 3 in a different operating condition.
Figure 7:
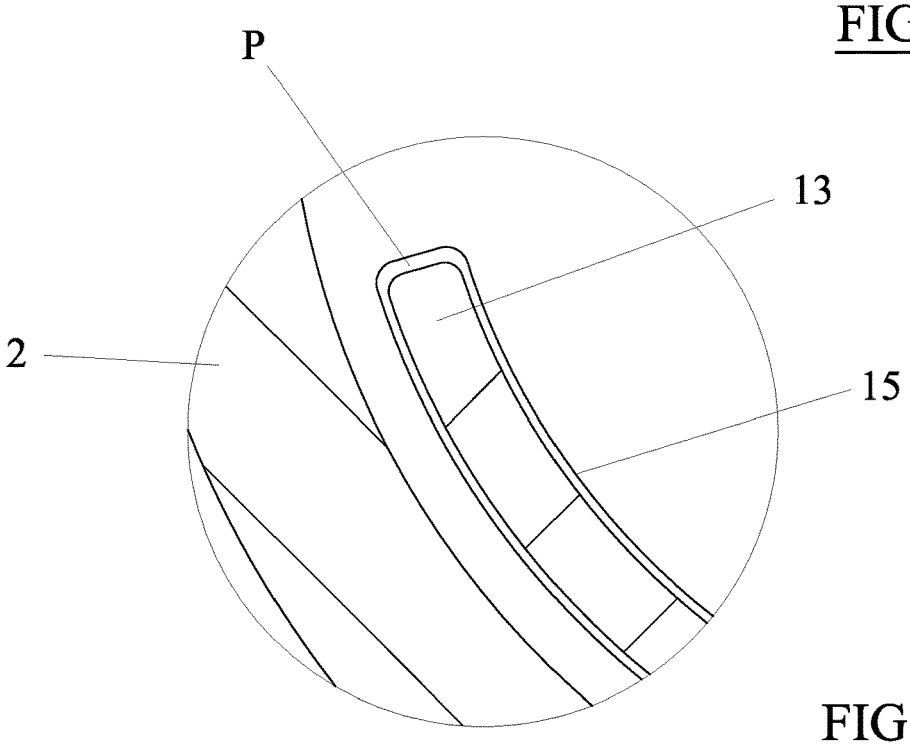
FIG. 7 is an enlargement of the part circled in FIG. 6.

In this way, when the valve element 10 is open (FIG. 4 and FIG. 7), the flow of the fluid substance S towards the nozzle 8 has a passage area P (FIG. 7) which allows a flow of the substance S without bottlenecks.

It is therefore sufficient for the second shutter 13 to displace (vertically), even only very slightly, to clear the passage area P, which is sized so as not to influence or restrict the flow of the substance S, the flow being regulated solely by the pressure regulator 9.

Therefore, the passage P, with the valve element 10 open, will have an area for the passage of the fluid substance S which is always greater than or equal to the area of the section of the passage section 20 which is controlled or determined by the pressure regulator 9 in those dispensing conditions.

The second shutter 13, alternatively, can comprise two or more protruding elements with a lip conformation (or with another conformation, for example cone, cylindrical, pyramid, etc.) which cooperate with a corresponding number of second seats or holes 15 obtained in the base body 2 (preferably with a conformation corresponding to that of the protruding elements), the said second seats or holes—when the valve element 10 is open—being in communication with the third section 7C of the conduit.

A number of protruding elements/second seats may be envisaged so as to delimit an overall passage area (when the valve element 10 is open) which is greater than that of the passage section 20 delimited by the regulator 9.

As is visible in the figures, the conduit can comprise a first section 7A upstream of the pressure regulator 9, a second section 7B between the pressure regulator 9 and the valve element 10, and a third section 7C between the valve element 10 and the nozzle 8.

Advantageously, the second section 7B of the conduit is determined by the volume present between the base body 2 and the membrane element 11.

To end the description, it must be highlighted that at least part of the base body 2 can be covered by a covering 16 with an aesthetic function (which may also be made of a metal material or with a metal finish), designed to hide the membrane 11 from the view of a user and at least part of the base body 2.

The covering 16 can feature an opening 16A which exposes at least part of said nozzle 8 to view.

Various embodiments of the innovation have been disclosed herein, but further embodiments may also be conceived using the same innovative concept.

The invention claimed is:

1. A dispensing system (100) comprising a container (5) configured to accommodate a fluid substance (S), the container comprising a hollow stem (4) and dispensing means (6) configured to deliver into a cavity (4A) of the hollow stem (4), following a translation of the hollow stem (4), said substance (5) under pressure, and a cap (1), the cap comprising a base body (2) in which a first seat (3) is defined, the seat being configured to sealedly couple to said hollow stem (4), the base body at least partially defining a conduit (7A, 7B, 7C), the conduit (7A, 7B, 7C) having a first end in fluid flow communication with said seat (3) and a second end associated with a spray nozzle (8), a pressure regulator (9) being provided on the conduit (7A, 7B, 7C) and being configured to regulate a passage section (20) of said substance (S) as a function of the pressure present in the cavity (4A) of the stem (4) in order to reduce the passage section if the pressure in said cavity (4A) increases and to increase the passage section if the pressure present in the cavity (4A) decreases, this to maintain a pressure, downstream of the pressure regulator (9) that is substantially constant even in the presence of a variable pressure upstream of the regulator (9), characterized by the fact that on the conduit (7A, 7B, 7C), between the pressure regulator (9) and the nozzle (8) there is at least a valve element (10) configured to close the conduit (7A, 7B, 7C) when a pressure lower than a predetermined threshold is present inside it, and to open the conduit when the pressure in a duct is higher than said threshold, the conduit (7A, 7B, 7C) being at least partially defined by a membrane element (11) which supports a first shutter (12) of the pressure regulator (9) and a second shutter (13) of the valve element (10), the first shutter (12) and the second shutter (13) being integrally made with said membrane (11).

2. The system according to claim 1, wherein said membrane is fixed to a base element (2).

3. The system according to claim 1, wherein, during dispensing, with the valve element (10) open, a passage area (P) of the fluid substance (S) through the valve element (10) is greater than or equal of the area of the passage section (20) controlled by the pressure regulator (9).

4. The system according to claim 1, wherein the second shutter (13) is lip-shaped, with an oblong curved shape, the valve element (10) comprising a second seat (15) having a shape corresponding to that shutter (13).

5. The system according to claim 4, wherein the curve is a circle or an ellipse.

6. The system according to claim 1, wherein said conduit comprises a first section (7A) upstream of the pressure regulator (9), a second section (7B) between the pressure regulator (9) and the valve element (10), the second section (7B) of the conduit being defined between the base body (2) and the membrane element (11), and a third section (7C) between the valve element (10) and the nozzle (8).

7. The system according to claim 1, wherein at least a part of the base body (2) is covered by a covering (16) with aesthetic functions, aimed at hiding said membrane (11) from the view of a user, the covering (16) providing an opening (16A) though which at least a part of said nozzle (8) is visible.

8. The system according to claim 1, wherein said container (5) is a pressurized vessel, and said dispensing means (6) comprise a valve opened by the translation of said stem (4) when said cap (1) is pressed.

9. The system according to claim 1, wherein said dispensing means comprise a pump actuated by the translation of a rod (4), which pressurizes said fluid substance (S) taken from the container (5), and conveys it, pressurized, into the cavity (4A) of the stem.

* * * * *